US009261837B2

(12) United States Patent
Yamada

(10) Patent No.: US 9,261,837 B2
(45) Date of Patent: Feb. 16, 2016

(54) ROLLER SUPPORT MECHANISM, ROLLER UNIT, AND FIXING DEVICE

(71) Applicant: KYOCERA Document Solutions Inc., Osaka-shi, Osaka (JP)

(72) Inventor: Masayuki Yamada, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 14/642,781

(22) Filed: Mar. 10, 2015

(65) Prior Publication Data

US 2015/0268609 A1 Sep. 24, 2015

(30) Foreign Application Priority Data

Mar. 20, 2014 (JP) ..... 2014-058809

(51) Int. Cl.
*G03G 15/20* (2006.01)
*B65H 3/00* (2006.01)
*G03G 21/16* (2006.01)

(52) U.S. Cl.
CPC ..... *G03G 15/2085* (2013.01); *B65H 3/00* (2013.01); *G03G 15/2025* (2013.01); *G03G 15/2075* (2013.01); *G03G 21/1647* (2013.01); *G03G 21/1685* (2013.01)

(58) Field of Classification Search
CPC ..... G03G 15/2085; G03G 15/2075
USPC ..... 399/328, 324, 325, 327
See application file for complete search history.

(56) References Cited

U.S. PATENT DOCUMENTS 4,943,831 A * 7/1990 Geraets ..... G03G 15/206 399/328
4,994,862 A * 2/1991 Hoover ..... G03G 15/2025 399/325
5,268,726 A * 12/1993 Oleksa ..... G03G 15/2064 399/328
5,477,316 A * 12/1995 Morganti ..... G03G 15/2025 399/324
6,377,774 B1 * 4/2002 Maul ..... G03G 15/2025 399/325
7,583,923 B2 * 9/2009 Chung ..... G03G 15/2064 399/328
8,014,712 B2 * 9/2011 Lee ..... G03G 15/2028 399/328
2002/0141796 A1 * 10/2002 Nishitani ..... G03G 15/2064 399/328
2014/0064801 A1 3/2014 Uchida
2014/0064802 A1 3/2014 Uchida

FOREIGN PATENT DOCUMENTS

JP H05333738 A 12/1993
JP H08297425 A 11/1996
JP 2005060089 A 3/2005
JP 2007217125 A 8/2007

* cited by examiner

*Primary Examiner* — Susan Lee

(57) ABSTRACT

A roller support mechanism supports a rotary shaft of a second roller disposed in parallel with a first roller. The roller support mechanism includes a support frame, a cover member, a bearing member, and an urging member. The support frame is made of sheet metal and has a support groove extending in a direction away from the first roller and receiving the rotary shaft. The cover member is made of sheet metal and is attached to the support groove to cover a pair of side edge sections facing each other across the support groove. The bearing member is made of resin and has a bearing groove that rotatably supports the rotary shaft. The bearing member is disposed in the support groove, with the cover member interposed therebetween, so as to be movable in a direction toward/away from a bottom of the support groove. The urging member urges the bearing member in a direction away from the bottom of the support groove.

9 Claims, 10 Drawing Sheets

ROLLER SUPPORT MECHANISM, ROLLER UNIT, AND FIXING DEVICE

INCORPORATION BY REFERENCE

The disclosure of Japanese Patent Application No. 2014-58809 filed on Mar. 20, 2014 including the specification, drawings and abstract is incorporated herein by reference in its entirety.

BACKGROUND

The present disclosure relates to a roller support mechanism for supporting a roller which is provided in, for example, a fixing device of an image forming apparatus.

Electrophotographic image forming apparatuses are equipped with a fixing device which causes a toner image transferred to printing paper to be fixed on the paper. The fixing device has a heating roller and a pressure roller, which are rotatably supported in the state where they are in pressure contact with each other. As a sheet of printing paper is passed through a nip between the heating and pressure rollers, heat is transmitted from the heating roller, causing the toner image to melt, so the image is fixed on the sheet.

SUMMARY

A roller support mechanism according to an aspect of the present disclosure supports a rotary shaft of a second roller disposed in parallel with a first roller. The roller support mechanism includes a support frame, a cover member, a bearing member, and an urging member. The support frame is made of sheet metal and has a support groove extending in a direction away from the first roller and receiving the rotary shaft. The cover member is made of sheet metal and attached to the support groove so as to cover a pair of side edge sections facing each other across the support groove. The bearing member is made of resin and has a bearing groove that rotatably supports the rotary shaft. The bearing member is disposed in the support groove, with the cover member interposed therebetween, so as to be movable in a direction toward/away from a bottom of the support groove. The urging member urges the bearing member in a direction away from the bottom of the support groove.

A roller unit according to another aspect of the present disclosure includes a second roller having a rotary shaft extending in parallel with a rotatably supported first roller; and the roller support mechanism configured as described above.

A fixing device according to a further aspect of the present disclosure includes: the roller unit configured as described above; a third roller, a first roller, a separation member, and a cleaning member. The third roller is rotatable and is heated by a heating device. The first roller is rotatable in a state of being in pressure contact with the third roller. The separation member is made of resin and abuts against a surface of the third roller for separating from the third roller a sheet that has passed through a nip between the third roller and the first roller. The cleaning member is provided on a surface of the second roller of the roller unit and abuts against the first roller for removing any foreign matter adhered to a surface of the first roller.

DETAILED DESCRIPTION

An embodiment of the present disclosure will be described below with reference to the drawings as appropriate. It should be noted that the embodiment described below is merely an example embodying the present disclosure; it is not intended to limit the technical scope of the present disclosure.

[Image Forming Apparatus 10]

Figure 1:
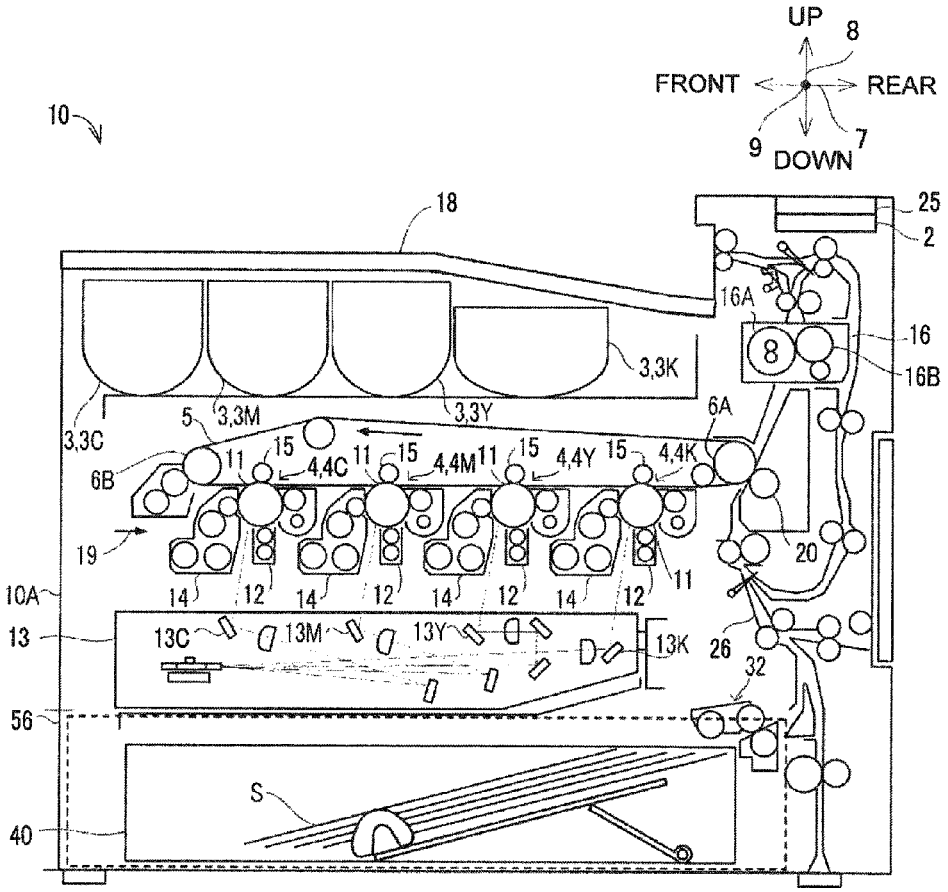
FIG. 1 shows the configuration of an image forming apparatus according to an embodiment of the present disclosure.

FIG. 1 shows the configuration of an image forming apparatus 10 according to an embodiment of the present disclosure. For convenience of explanation, an up-and-down direction 8 is defined to correspond to the vertical direction in an installed state (as shown in FIG. 1) where the image forming apparatus 10 has been set up and is ready for use. A front-and-rear direction 7 is defined with the surface of the apparatus having an opening for receiving a paper cassette 40 shown in FIG. 1 in the installed state being regarded as the front side. A right-and-left direction 9 is defined with respect to the front side of the image forming apparatus 10 in the installed state.

The image forming apparatus 10 has a casing 10A, which is in an approximately rectangular parallelepiped shape as a whole. Components constituting the image forming apparatus 10 are disposed inside the casing 10A. As shown in FIG. 1, in a lower portion on the front side of the casing 10A, an opening 41 is formed which is wide in the right-and-left direction 9. The paper cassette 40 can be housed inside the casing 10A via this opening 41.

The image forming apparatus 10 is a so-called tandem type color image forming apparatus. The apparatus 10 includes a plurality of image forming units 4, an intermediate transfer belt 5, an optical scanning device 13, a secondary transfer roller 20, a fixing device 16, a sheet tray 18, the paper cassette 40, a paper feeding unit 32, an operation display unit 25, a paper transport path 26, and a control unit 2. The image forming apparatus 10 forms a monochrome or color image on a sheet S, on the basis of input image data. The sheet S may be a sheet of paper, a sheet of coated paper, a postcard, an envelope, an overhead projector (OHP) sheet, or the like. It should be noted that the image forming apparatus 10 according to the embodiment of the present disclosure is not limited to the tandem type color image forming apparatus; it may be a printer, a copier, a facsimile machine, or a multifunctional peripheral having the functions of these devices, as long as it can form color and/or monochrome images.

The operation display unit 25 is a touch panel, for example, which displays various kinds of information in accordance with control instructions from the control unit 2 and inputs various kinds of information into the control unit 2 in response to user operations.

Each of the image forming units 4 (4C, 4M, 4Y, 4K) is an electrophotographic image forming unit which includes, among others, a photoconductive drum 11, a charging device 12, a development device 14, and a primary transfer roller 15. The image forming units 4 are arranged side by side in the (horizontal) direction in which the intermediate transfer belt 5 travels, to constitute the so-called tandem type image forming units. More specifically, the image forming units 4C, 4M, 4Y, and 4K form toner images of cyan (C), magenta (M), yellow (Y), and black (K), respectively. The image forming unit 4C for cyan, the image forming unit 4M for magenta, the image forming unit 4Y for yellow, and the image forming unit 4K for black are disposed in line in this order from the upstream side of the traveling direction (indicated by an arrow 19 in the figure) of the intermediate transfer belt 5.

The intermediate transfer belt 5 is an intermediate transfer member onto which toner images of the respective colors formed on the photoconductive drums 11 of the corresponding image forming units 4 are intermediately transferred. A driving roller 6A and a driven roller 6B support the intermediate transfer belt 5 in a rotatively drivable manner. The intermediate transfer belt 5, supported by the driving roller 6A and the driven roller 6B, can move (travel) with its surface in contact with the surface of each photoconductive drum 11. As the intermediate transfer belt 5 passes between the photoconductive drums 11 and the primary transfer rollers 15, the toner images are transferred from the respective photoconductive drums 11 onto the belt surface so that they are successively superposed on one another. The optical scanning device 13 includes a laser light source which emits laser beams of the respective colors, polygon mirrors which scan the laser beams, and mirrors 13C, 13M, 13Y, and 13K which reflect and guide the scanned laser beams. The optical scanning device 13 irradiates the photoconductive drums 11 in the image forming units 4 with the laser beams, on the basis of the input image data of the corresponding colors, to form electrostatic latent images on the respective photoconductive drums 11.

The paper feeding unit 32 takes one sheet S at a time from the sheets stacked in the paper cassette 40, and feeds each sheet S onto the paper transport path 26.

In the image forming apparatus 10 configured as described above, on a sheet S supplied from the paper cassette 40 through the paper transport path 26, a color image is formed in such a manner as described below, and the sheet S with the image formed thereon is discharged onto the sheet tray 18. It should be noted that the paper transport path 26 is equipped with various transport rollers which transport a sheet S, stacked in the paper cassette 40, through the secondary transfer roller 20 and the fixing device 16, to the sheet tray 18.

First, in each of the image forming units 4, the photoconductive drum 11 is uniformly charged at a prescribed potential by the charging device 12. Next, the optical scanning device 13 irradiates the surface of each photoconductive drum 11 with laser beam based on image data, to form an electrostatic latent image on the surface of each photoconductive drum 11. The electrostatic latent image on each photoconductive drum 11 is developed by the corresponding development device 14, so that a visible, toner image of the corresponding color is obtained. It should be noted that toners (developers) of the corresponding colors are supplied from detachable toner containers 3 (3C, 3M, 3Y, 3K) to the development devices 14.

The color toner images formed on the photoconductive drums 11 of the respective image forming units 4 are transferred by the primary transfer rollers 15 onto the intermediate transfer belt 5 so that they are superposed successively. As a result, a color toner image based on the image data is formed on the intermediate transfer belt 5. The color toner image on the intermediate transfer belt 5 is then transferred by the secondary transfer roller 20 onto a sheet S which has been transported from the paper cassette 40 on the paper transport path 26. The sheet S with the color toner image transferred thereon is transported to the fixing device 16 by the above-described transport rollers.

The fixing device 16 has a heating roller 16A (an example of the third roller), which is heated to a high temperature, and a pressure roller 16B (an example of the first roller), which is disposed to face the heating roller 16A. The sheet S that has reached the fixing device 16 is transported in the state of being sandwiched between the heating roller 16A and the pressure roller 16B, during which the color toner image is fused onto the sheet S. Thereafter, the sheet S is discharged to the sheet tray 18. The configuration of the fixing device 16 will be described in detail later.

The image forming apparatus 10 further includes a contact/separation mechanism which brings the intermediate transfer belt 5 into contact with, or separates it from, the photoconductive drums 11 and the primary transfer rollers 15 in the image forming units 4C, 4M, and 4Y When a monochrome image is to be printed in the image forming apparatus 10, the photoconductive drums 11 and the primary transfer rollers 15 in the image forming units 4C, 4M, and 4Y are separated from the intermediate transfer belt 5 by the contact/separation mechanism, so that a black toner image alone is transferred from the image forming unit 4K to the intermediate transfer belt 5, and the monochrome image is transferred from the intermediate transfer belt 5 to a sheet S. While the electrophotographic image forming units 4 have been described by way of example in the present embodiment, the image forming units 4 are not limited thereto; they may use an ink-jet recording system, or other recording or printing system.

The control unit 2 is responsible for overall control of the image forming apparatus 10. The control unit 2 is configured as a microcomputer which has, as its main components, a CPU, a ROM, a RAM, and an EEPROM. Inside the image forming apparatus 10, the control unit 2 is connected with the image forming units 4, the secondary transfer roller 20, the fixing device 16, the driving roller 6A, the paper feeding unit 32 and the like, and controls these components. The control unit 2 is also connected with the elements constituting the image forming units 4, including the charging devices 12, the optical scanning devices 13, the development devices 14, and the primary transfer rollers 15.

As described above, the image forming apparatus 10 causes the image forming units 4 (4C, 4M, 4Y, 4K) to transfer toner images of the respective colors, one on another, onto a surface of the intermediate transfer belt 5 while the belt is traveling, so that a color toner image is formed on the surface of the intermediate transfer belt 5. Further, the image forming apparatus 10 causes the secondary transfer roller 20 to transfer the thus formed color toner image from the intermediate transfer belt 5 onto a sheet S, so that the color toner image is formed on the sheet S.

[Fixing Device 16]

Figure 2:
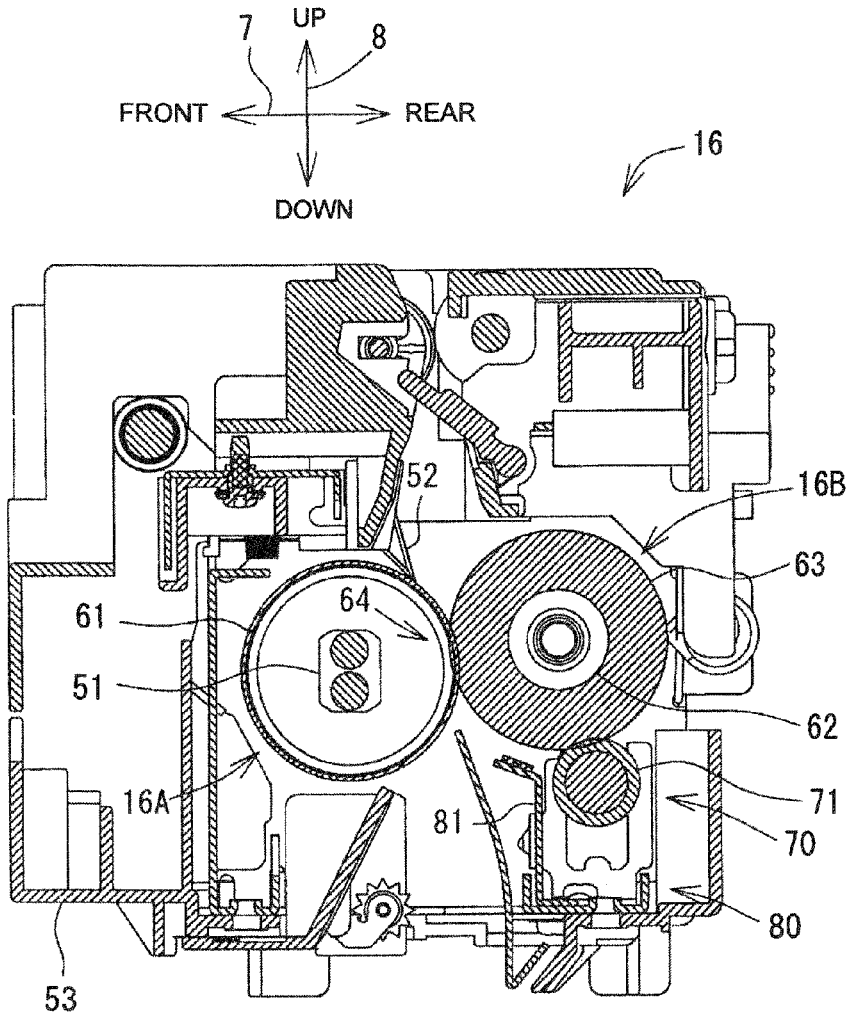
FIG. 2 shows the configuration of a fixing device according to the embodiment of the present disclosure.

The fixing device 16 according to the embodiment of the present disclosure will now be described. As shown in FIG. 2, the fixing device 16 includes the heating roller 16A, the pressure roller 16B, a heater 51 (an example of the heating device), a separation blade 52 (an example of the separation member), and a cleaning unit 70 (an example of the roller unit). These components are disposed inside a casing 53 of the fixing device 16.

The heating roller 16A has a roller body 61 formed in a cylindrical shape. The roller body 61 has a roller surface which is brought into contact with a surface to be developed of a sheet S (i.e. the sheet surface with a toner image formed thereon) at the time of fixing. The roller body 61 is made of a material having high heat conductivity, which may be, for example, aluminum or other metal. The surface of the roller body 61 is coated with a fluororesin layer for ensuring easy separation of toner. The roller body 61 has rotary shafts provided at both ends. These rotary shafts are rotatably supported by, for example, an internal frame constituting the casing 53, thereby making the heating roller 16A rotatable.

The heating roller 16A has the heater 51 disposed inside the roller body 61. The heater 51 includes a halogen lamp, for example. The heater 51 extends in an axial direction inside the roller body 61, so that the roller body 61 is heated over the entire area in the axial direction from within by the heater 51. It should be noted that the heater 51 is merely an example of the heating device. Another heating device, such as an induction heating device which causes the heating roller 16A to produce heat by itself by an effect of flux, may be used alternatively.

The pressure roller 16B is arranged in parallel with the heating roller 16A, to face the heating roller 16A. The pressure roller 16B is disposed behind the heating roller 16A in FIG. 2. The pressure roller 16B is supported by the casing 53 in such a way as to be rotatable in the state where the roller is in pressure contact with the surface of the heating roller 16A with a prescribed pressure. Specifically, a rotary shaft 62 is provided at the center of the pressure roller 16B, and this rotary shaft 62 is rotatably supported by, for example, an internal frame constituting the casing 53, thereby making the pressure roller 16B rotatable. The pressure roller 16B is connected to a motor which is driven and controlled by the control unit 2 (see FIG. 1). As the motor is rotatively driven, the rotational driving force is transmitted to the pressure roller 16B, causing the roller to rotate clockwise in FIG. 2. The rotary shaft 62 of the pressure roller 16B is provided with an elastic section 63 of a cylindrical shape, which is made of, for example, silicon with elasticity or porous rubber. Further, the pressure roller 16B is in pressure contact with the heating roller 16A by a spring or the like. Thus, by being in pressure contact with the roller body 61, the elastic section 63 is elastically deformed and bent inward, so that a nip 64 is formed between the heating roller 16A and the pressure roller 16B. Further, with the contact friction at the nip 64, the heating roller 16A rotates counterclockwise in FIG. 2 following the rotation of the pressure roller 16B.

In the fixing device 16, a sheet S is transported to pass through the nip 64 upward. The separation blade 52 is disposed downstream of the nip 64 in the paper transport direction. The separation blade 52 serves to prevent the sheet S that has passed through the nip 64 from being adhered to and wound around the heating roller 16A. A plurality of such separation blades 52 are arranged in the longitudinal direction of the heating roller 16A. In the present embodiment, each separation blade 52 has a pointed end, which abuts against the roller surface of the heating roller 16A. With this configuration, the separation blades 52 are able to separate a sheet S from the heating roller 16A at the time when the sheet S comes out of the nip 64. Each separation blade 52 is made of synthetic resin for avoiding damages to the roller surface of the heating roller 16A.

When the separation blade 52 made of synthetic resin undergoes contact friction with the rotating heating roller 16A, the separation blade 52 may be worn away and abrasion powder may be produced. When such abrasion powder is attached to the surface of the heating roller 16A and reaches the nip 64 by the rotation of the heating roller 16A, the abrasion powder may be heated by the heating roller 16A and pressed by the pressure roller 16B, and thus, it may be fused onto the sheet S. In view of the foregoing, in the present embodiment, the fixing device 16 is provided with the cleaning unit 70.

[Cleaning Unit 70]

Figure 3:
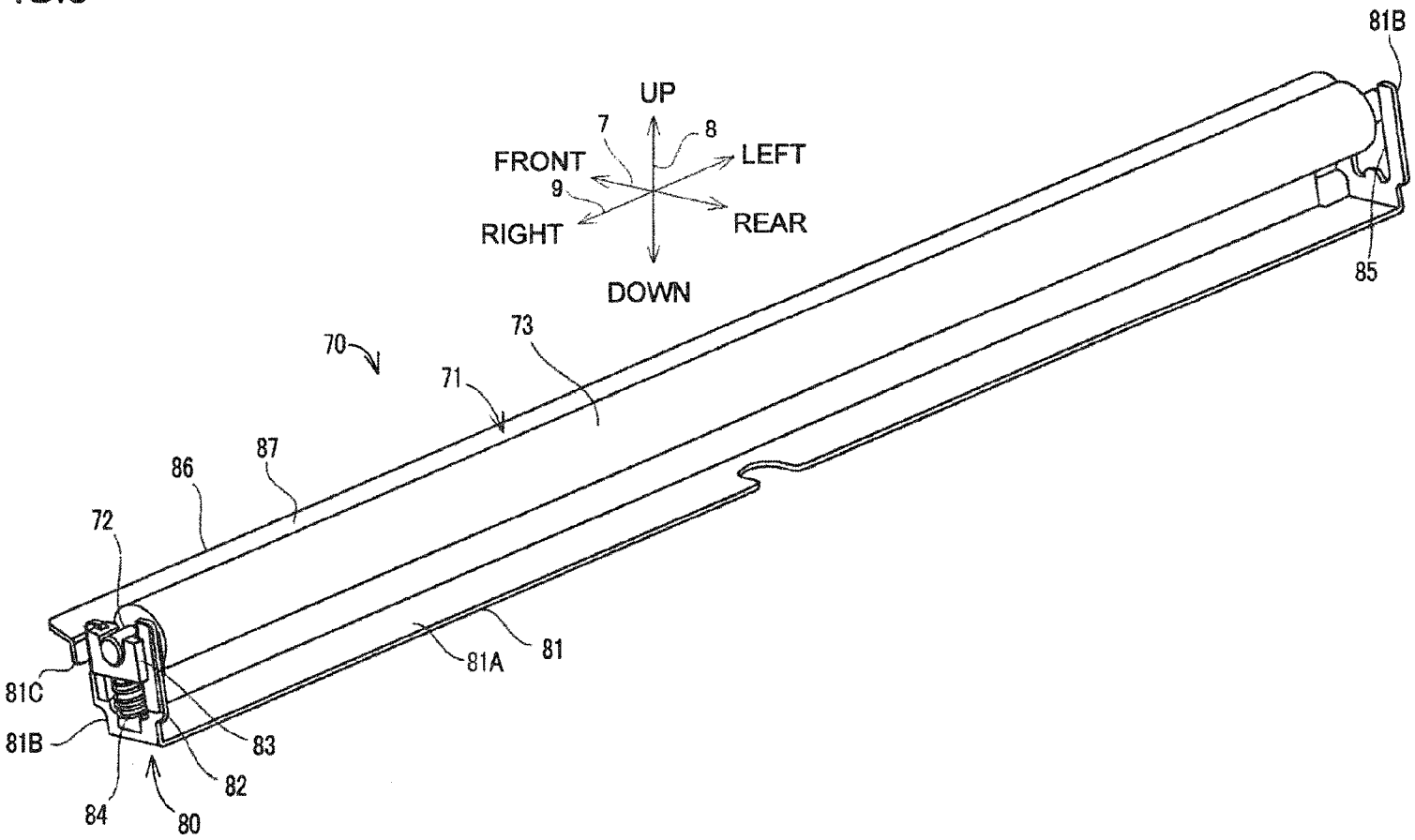
FIG. 3 shows the configuration of a roller unit according to the embodiment of the present disclosure.

The cleaning unit 70 will now be described. As shown in FIG. 2, the cleaning unit 70 is placed beneath the pressure roller 16B. The cleaning unit 70 is of a shape elongated in the longitudinal direction of the pressure roller 16B, as shown in FIG. 3, and extends in a direction (corresponding to the right-and-left direction 9) that is perpendicular to the paper plane of FIG. 2. This cleaning unit 70 is for cleaning the roller surface of the pressure roller 16B by capturing any above-described abrasion powder that has moved from the heating roller 16A onto the pressure roller 16B. As shown in FIGS. 2 and 3, the cleaning unit 70 includes: a cleaning roller 71 (an example of the second roller), and a support mechanism 80 (an example of the roller support mechanism) for supporting the cleaning roller 71. The support mechanism 80 includes: a support frame 81, a cover member 82, a bearing member 83, and an urging member 84. It should be noted that the bearing member 83 and the urging member 84 are not illustrated in FIG. 2. Further, in FIG. 3, the illustration of the structure of the support frame 81 at its left end is partially omitted.

The cleaning roller 71 is arranged in parallel with the pressure roller 16B. The cleaning roller 71 is supported by the support mechanism 80 such that it can rotate in the state where it is in pressure contact with the surface of the pressure roller 16B with a prescribed pressure. The cleaning roller 71 has a rotary shaft 72 at its center, and this rotary shaft 72 is rotatably supported by the support mechanism 80. The rotary shaft 72 of the cleaning roller 71 is provided with a cleaning member 73 made of, for example, nonwoven fabric. This cleaning member 73 constitutes the roller surface of the cleaning roller 71. With the cleaning roller 71 being in pressure contact with the surface of the pressure roller 16B, the cleaning member 73 removes any foreign matters, including the above-described abrasion powder, adhered to the surface of the pressure roller 16B. As the pressure roller 16B rotates, the cleaning roller 71 undergoes contact friction with the pressure roller 16B, so it rotates counterclockwise in FIG. 2 following the rotation of the pressure roller 16B. It should be noted that the material for the cleaning member 73 is not limited to nonwoven fabric; any material is applicable as long as it can remove the foreign matters including the abrasion powder.

Figure 4A:
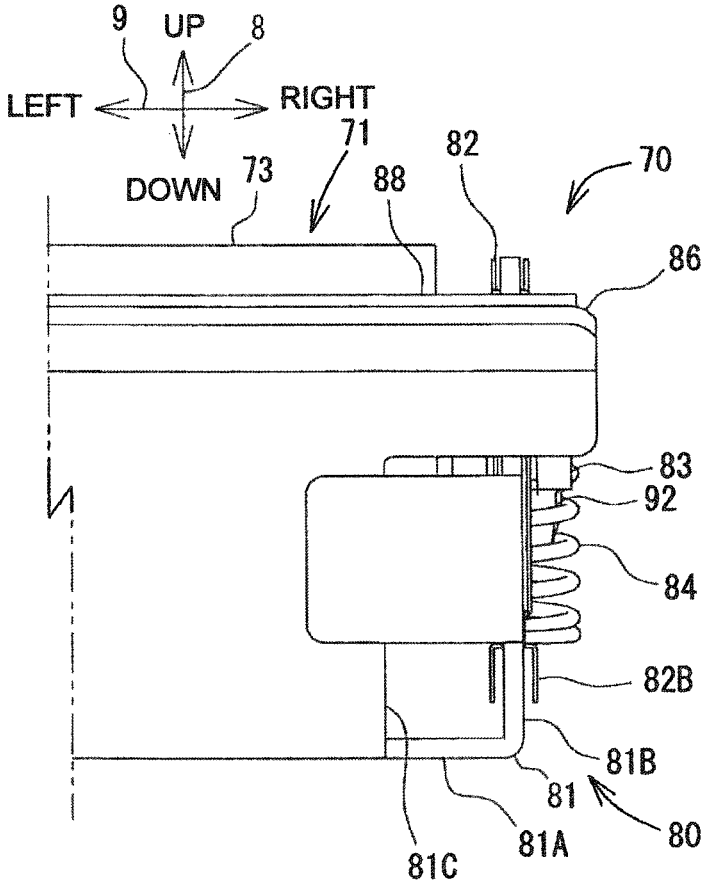
FIG. 4A shows a right end portion, as seen from the front, of the roller unit in FIG. 3.
Figure 4B:
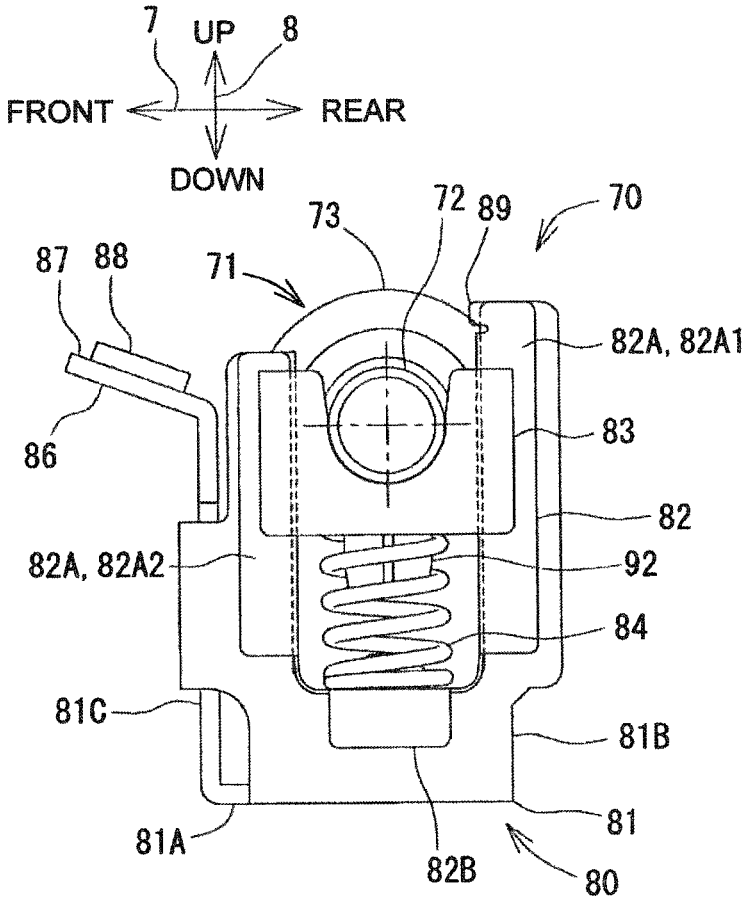
FIG. 4B shows the right end portion, as seen from the right, of the roller unit in FIG. 3.

As shown in FIGS. 3, 4A, and 4B, the support frame 81 is of a shape elongated in the right-and-left direction 9. The support frame 81 is made of so-called sheet metal. In the present embodiment, the support frame 81 is formed by a steel plate of SPCC steel or the like. The sheet metal is subjected to cutting and bending to form the support frame 81. As shown in FIGS. 4A and 4B, the support frame 81 has a base section 81A, which is elongated in the right-and-left direction 9. The base section 81A constitutes the bottom of the cleaning unit 70, and this base section 81A is fixedly secured to the casing 53 of the fixing device 16. The base section 81A has its both ends in the longitudinal direction bent perpendicularly upward, so that side sections 81B are formed at the respective ends of the base section 81A.

At each side section 81B, a support groove 85 is formed to extend downward, or, away from the pressure roller 16B. In other words, the support frame 81 has the support groove 85. In the present embodiment, the rotary shaft 72 of the cleaning roller 71 is inserted into the support groove 85, as will be described later.

The base section 81A has its front end bent perpendicularly upward, so that a front section 81C (an example of the static electricity eliminating section) is formed at the front end of the base section 81A. In other words, the support frame 81 has the front section 81C. The front section 81 C extends up to a position close to the roller surface of the pressure roller 16B. The front section 81C, located in proximity to the pressure roller 16B, serves to eliminate static electricity charged in the pressure roller 16B. The front section 81C has its upper end inclined frontward, to thereby form an inclined section 86. The inclined section 86 has a surface 87 on the pressure roller 16B side, facing the outer peripheral surface of the pressure roller 16B, and a buffer member 88 made of felt, for example, is bonded on this surface 87. The buffer member 88 has a shape elongated in the longitudinal direction of the support frame 81. It should be noted that the illustration of the buffer member 88 is omitted in FIG. 3. With the presence of the buffer member 88, even if the pressure roller 16B and/or the support mechanism 80 is misaligned because of external impact or environmental temperature, there will be no direct contact between the inclined section 86 and the pressure roller 16B; the buffer member 88 will avoid damages to the pressure roller 16B. It should be noted that the buffer member 88 is not limited to felt; any material is applicable as long as it produces the buffering function.

Figure 5A:
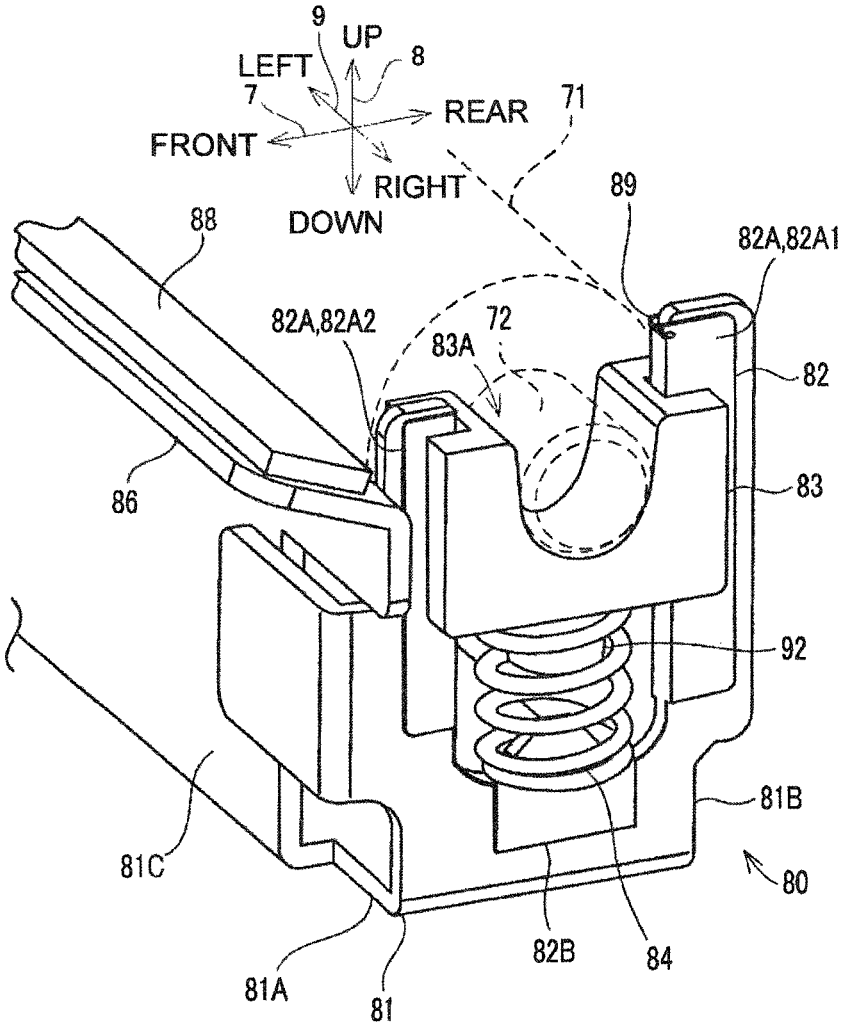
FIG. 5A shows the configuration of a roller support mechanism according to the embodiment of the present disclosure, with a cover member attached to a support groove.
Figure 5B:
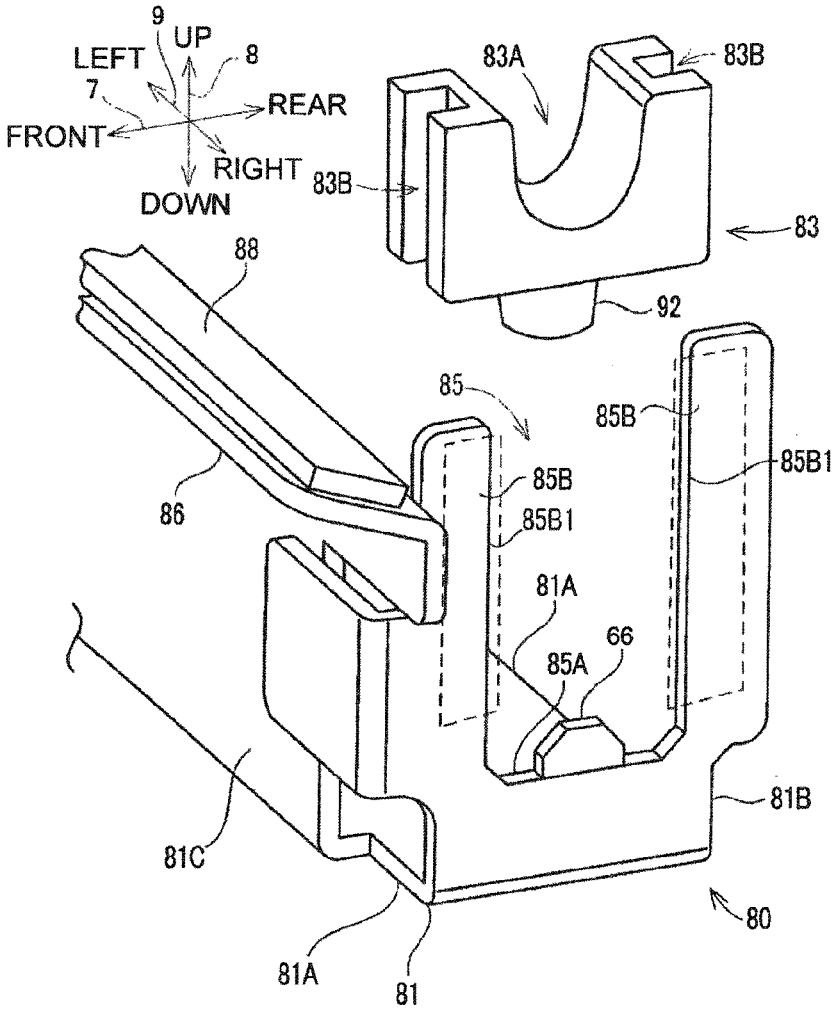
FIG. 5B shows the configuration of the roller support mechanism according to the embodiment of the present disclosure, with no cover member attached to the support groove.

As shown in FIG. 5B, a projection 66 is provided at a bottom section 85A of the support groove 85. In other words, the support frame 81 has the projection 66. The projection 66 is configured to project upward from the central portion of the bottom section 85A. The projection 66 is for supporting a lower end of the urging member 84 and also positioning the lower end at the center of the bottom section 85A. The urging member 84 is a coil spring. As shown in FIG. 5A, at the lower end of the urging member 84, the projection 66 is inserted into the urging member 84, so that the lower end of the urging member 84 is supported in the support groove 85.

The cover member 82 is attached to the support groove 85. More specifically, the cover member 82 is attached to the support groove 85 so as to cover a pair of side edge sections 85B (see FIG. 5B) facing each other across the support groove 85. The cover member 82 is made of so-called sheet metal. In the present embodiment, the cover member 82 is formed by a steel plate of SUS (stainless steel) or the like. The sheet metal is subjected to cutting and bending to form the cover member 82.

Figure 6:
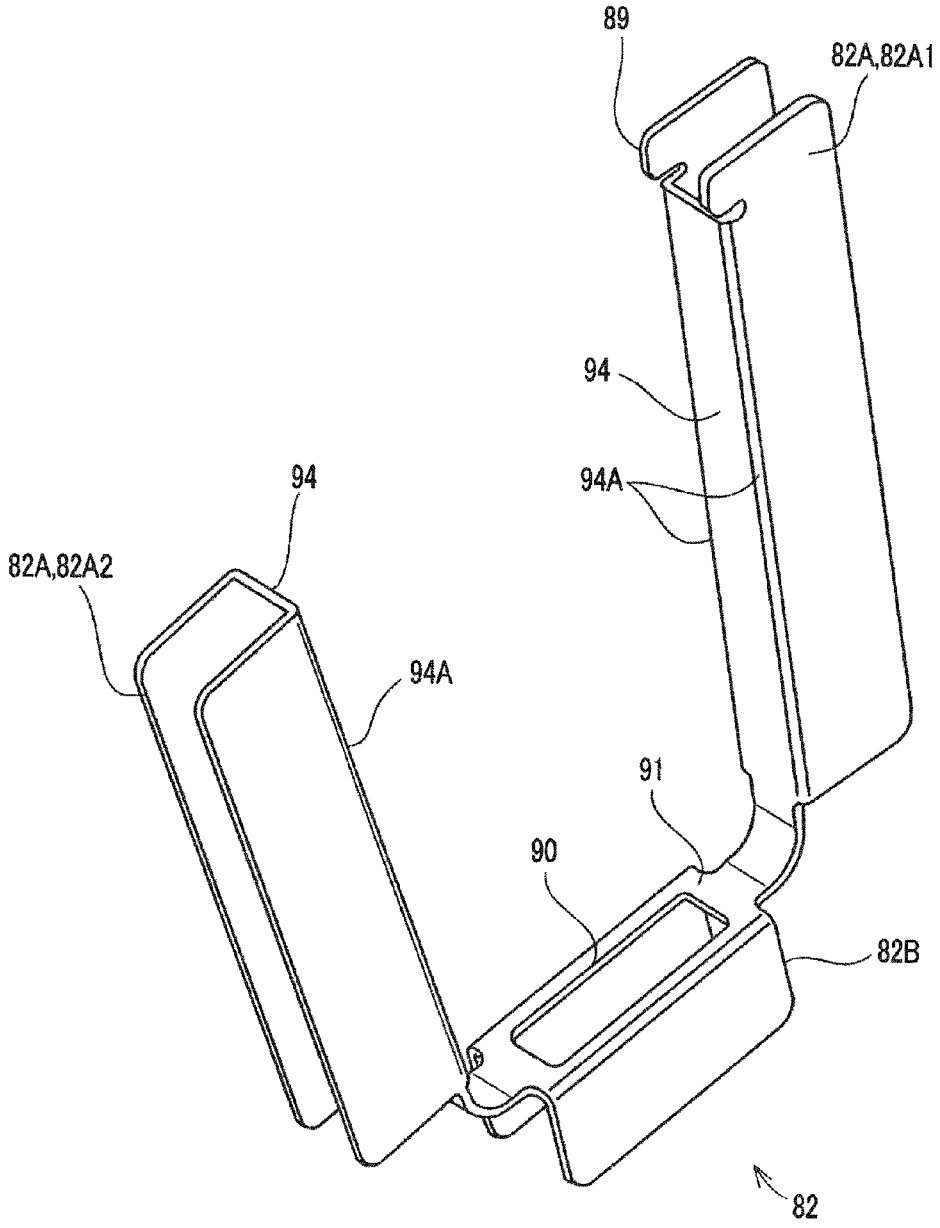
FIGS. 6 and 7 show the configuration of the cover member of the roller support mechanism shown in FIGS. 5A and 5B.

As shown in FIG. 6, the cover member 82 has a pair of first regions 82A, which cover the corresponding side edge sections 85B, respectively, and a second region 82B, which covers the bottom section 85A of the support groove 85. As shown in FIG. 5A, each first region 82A covers, not only the end on the support groove 85 side of the side edge section 85B, but also an area ranging from that end onto side surfaces of the side section 81B (as delimited by the broken line in FIG. 5B). This enables the cover member 82 to cover corner sections 85B1 at the end of each side edge section 85B. In the present embodiment, each first region 82A is formed by bending sheet metal so as to cover the corresponding side edge section 85B. As a result, end sections 94A in the width direction of an inner side surface 94 of each first region 82A have curved surfaces which are roundish rather than pointed.

Of the paired first regions 82A, the first region 82A1 on the rear side is provided with a protruding section 89. The protruding section 89 is arranged at an upper end (on the pressure roller 16B side) of the first region 82A1. The protruding section 89 protrudes from the upper end of the first region 82A1 in the direction of the other first region 82A2 on the front side. With this configuration, when the cover member 82 and the bearing member 83 are attached to the support groove 85, as will be described later, the protruding section 89 functions as a stopper, preventing the bearing member 83 from slipping off upward. Although it is sufficient to provide the protruding section 89 for at least one of the paired first regions 82A, the protruding sections 89 may be provided for both first regions 82A.

Further, the second region 82B of the cover member 82 has an opening section 90. The opening section 90 is formed in a surface 91 of the second region 82B which will face the bottom section 85A of the support groove 85. The opening section 90 is shaped and dimensioned such that, when the cover member 82 is attached to the support groove 85, the projection 66 at the bottom section 85A can be inserted into the opening section 90. That is, when the cover member 82 is attached to the support groove 85, the projection 66 penetrates through and protrudes upward from the opening section 90, and is exposed to the support groove 85. In this state, the urging member 84 is attached to the projection 66.

Figure 7:
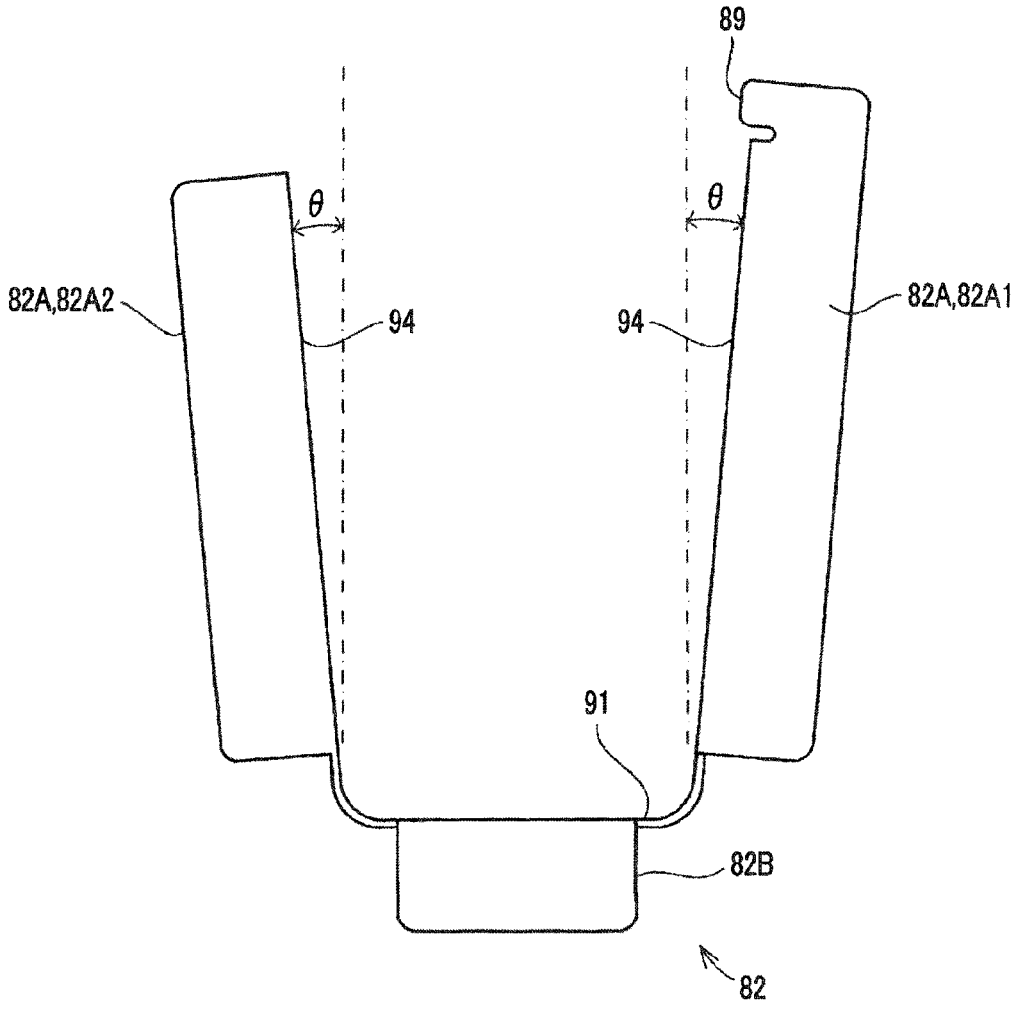

The cover member 82 is formed such that, in the state where the cover member 82 is attached to the support groove 85, each of the paired first regions 82A produces an elastic force acting on the corresponding side edge section 85B to press it outward. Specifically, as shown in FIG. 7, the paired first regions 82A are inclined in the directions where their distance increases gradually. More specifically, the first region 82A1 on the rear side is inclined outward (backward) by an angle θ with respect to the vertical direction, with the junction with the second region 82B as the base point. The first region 82A2 on the front side is likewise inclined outward (frontward) by the angle θ with respect to the vertical direction, with the junction with the second region 82B as the base point. This inclination angle θ is set such that the distance between the first regions 82A is at least larger than the width in the front-and-rear direction 7 of the support groove 85. Therefore, as the cover member 82 is fitted onto the support groove 85 which is narrower in width than the cover member 82, the cover member 82 is stably supported by the support groove 85. Although not shown in the figure, a mechanism may be provided which makes the inner walls of the cover member 82 and the support groove 85 engaged with each other when the cover member 82 is fitted on the support groove 85.

The bearing member 83 is attached to the support groove 85 together with the cover member 82. The bearing member 83 is made of synthetic resin. In the present embodiment, the bearing member 83 is manufactured by molding a polyphenylene sulfide (PPS) resin which is high in heat resistance, strength, and stiffness, and also excellent in wear resistance. It is of course possible to form the bearing member 83 with a synthetic resin other than PPS resin. The bearing member 83 has a bearing groove 83A (see FIG. 5B). The bearing groove 83A is formed in an upper portion of the bearing member 83, and supports the rotary shaft 72 of the cleaning roller 71. The bearing groove 83A has its bottom section formed in an arc shape with the size approximately equal to that of the rotary shaft 72. This allows the bearing groove 83A to smoothly rotatably support the rotary shaft 72.

The bearing member 83 is fitted to the support groove 85 in the state where the cover member 82 is interposed therebetween and where the urging member 84 is supported in the support groove 85 through the intermediary of the cover member 82. As the bearing member 83 is fitted to the support groove 85, the bearing member 83 becomes movable in a direction (up-and-down direction 8) toward/away from the bottom section 85A of the support groove 85. In other words, the bearing member 83 is attached to the support groove 85 in such a way as to be movable in the up-and-down direction 8. To make the bearing member 83 movable in the support groove 85, the bearing member 83 is provided with guide grooves 83B (see FIG. 5B). The guide grooves 83B are formed on the respective sides in the front-and-rear direction 7 of the bearing member 83, as shown in FIG. 5B. Each guide groove 83B extends in the up-and-down direction 8. Each guide groove 83B has a groove width capable of receiving the first region 82A of the cover member 82. When the cover member 82 is attached to the support groove 85 and the first regions 82A of the cover member 82 are inserted into the corresponding guide grooves 83B, then the guide grooves 83B guide the bearing member 83 so as to be movable in the up-and-down direction 8.

The urging member 84 is a coil spring. The urging member 84 urges the bearing member 83 in the (upward) direction away from the bottom section 85A of the support groove 85. In the present embodiment, the urging member 84 is disposed, in the state where the cover member 82 is attached to the support groove 85, between the bearing member 83 and the projection 66 that protrudes from the opening section 90 of the cover member 82. As shown in FIGS. 5A and 5B, the bearing member 83 has its bottom section provided with a spring seat 92 in the form of a projection which is inserted into the urging member 84 from an upper end of the urging member 84. The urging member 84 has its upper end positioned in place by the spring seat 92 and its lower end positioned in place by the projection 66, whereby the urging member 84 is secured between the bottom section 85A and the bearing member 83. It should be noted that the urging member 84 is not limited to the coil spring. All that is needed for the urging member 84 is to urge the bearing member 83 upward in the state where the urging member 84 is attached to the support groove 85. Besides a spring-type structure, a rubber or other elastic member, or another type of structure is applicable.

Figure 8:
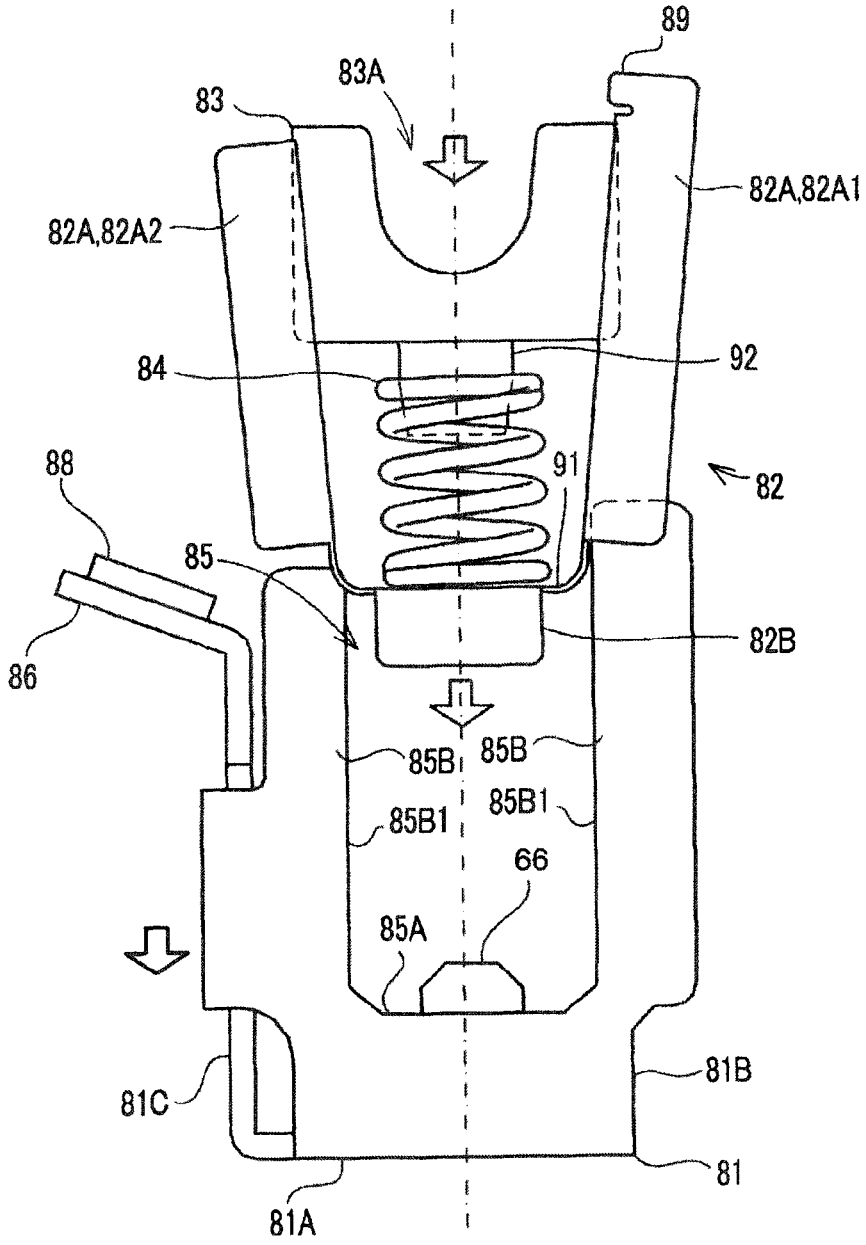
FIG. 8 is an exploded view of the roller support mechanism shown in FIGS. 5A and 5B.

The bearing member 83 is fitted to the support groove 85 in the following manner. First, as shown in FIG. 8, only the lower end of the cover member 82 is inserted into the support groove 85. In this state, the first regions 82A of the cover member 82 are each inclined outward by the angle θ, so the distance between the first regions 82A is larger than the width of the support groove 85. In this state, the urging member 84 is positioned to abut against the surface 91 at the bottom of the cover member 82, and the bearing member 83 is inserted into the support groove 85 on top of the urging member 84. At this time, as the first regions 82A are separated from each other by the distance larger than the width of the support groove 85, the bearing member 83 is smoothly inserted into the support groove 85 without being obstructed by the protruding section 89. The cover member 82, the urging member 84, and the bearing member 83 are pressed downward altogether, so that they enter the support groove 85 toward its bottom section 85A. During this process, the distance between the first regions 82A is gradually decreased as they are pressed by the side edge sections 85B. Then, in the state where the cover member 82, the urging member 84, and the bearing member 83 are fitted to the support groove 85 (see FIG. 4B), the protruding section 89 moves toward the inside of the support groove 85 so that it is overlaid on the upper surface of the bearing member 83. This allows the protruding section 89 to serve as the stopper to prevent the bearing member 83 from slipping off upward.

With the support mechanism 80 of the cleaning unit 70 configured as described above, while the bearing member 83 is movable in the up-and-down direction 8 in the support groove 85, the bearing member 83 does not come into direct contact with the corner sections 85B1 of the side edge sections 85B of the support groove 85. This prevents production of abrasion powder otherwise caused by the contact with the corner sections 85B1. During the movement of the bearing member 83, the member 83 slides on the first regions 82A of the cover member 82. The end sections 94A in the width direction of the inner side surface 94 of each first region 82A are rounded rather than pointed, so the bearing member 83 slides smoothly, without being worn away. As the production of the abrasion powder as described above is prevented, no abrasion powder enters into the bearing groove 83A of the bearing member 83, so no abnormal noise is produced during rotation between the rotary shaft 72 of the cleaning roller 71 and the bearing groove 83A. Further, as no abrasion powder is produced, there is no problem of degradation in image quality otherwise caused by the abrasion powder fused onto a sheet S. That is, the support mechanism 80 according to the present embodiment can stably support the cleaning roller 71 disposed in the fixing device 16.

Further, the first regions 82A of the cover member 82 are inclined outward, as shown in FIG. 7. Therefore, when the bearing member 83 is fitted to the support groove 85 in accordance with the above-described procedure, the bearing member 83 can readily be fitted, without being obstructed by the protruding section 89.

In the above embodiment, each of the first regions 82A of the cover member 82 was configured, by way of example, to cover the area including the end on the support groove 85 side of the side edge section 85B and extending onto the side surfaces of the side section 81B (see FIG. 5B). The present disclosure, however, is not limited thereto. All that is needed for the cover member 82 is to cover at least the corner sections 85B1 of the ends of the side edge sections 85B, which can prevent the bearing member 83 from being worn away by the corner sections 85B1.

In the above embodiment, the support mechanism 80 for the cleaning roller 71 in the cleaning unit 70 was described by way of example. The present disclosure, however, is not limited thereto. For example, the support mechanism 80 is applicable to a mechanism which supports the pressure roller 16B in a pressure contact state with the heating roller 16A.

What is claimed is:

1. A roller support mechanism supporting a rotary shaft of a second roller disposed in parallel with a first roller, the roller support mechanism comprising:

a support frame made of sheet metal and having a support groove extending in a direction away from the first roller, the support groove receiving the rotary shaft;

a cover member made of sheet metal and attached to the support groove so as to cover a pair of side edge sections facing each other across the support groove;

a bearing member made of resin and having a bearing groove rotatably supporting the rotary shaft, the bearing member being disposed in the support groove, with the cover member interposed therebetween, so as to be movable in a direction toward/away from a bottom of the support groove; and an urging member that urges the bearing member in a direction away from the bottom of the support groove.

2. The roller support mechanism according to claim 1, wherein the cover member covers at least corner sections of the side edge sections.

3. The roller support mechanism according to claim 1, wherein the cover member has a pair of first regions that cover the pair of side edge sections, respectively, and a protruding section that is provided at an end on the first roller side of at least one of the first regions and protrudes toward the other one of the first regions.

4. The roller support mechanism according to claim 3, wherein the bearing member has a guide groove configured to receive the first region and guide the bearing member in the direction toward/away from the bottom of the support groove.

5. The roller support mechanism according to claim 3, wherein the support frame has a projection provided at the bottom of the support groove, the cover member has a second region that covers the bottom of the support groove and an opening section that is formed in the second region and capable of receiving the projection inserted therethrough, and the urging member is disposed between the bearing member and the projection protruding from the opening section in the state where the cover member is attached to the support groove.

6. The roller support mechanism according to claim 1, wherein the support frame has a static electricity eliminating section that is placed in proximity to the first roller for eliminating static electricity charged in the first roller.

7. The roller support mechanism according to claim 1, wherein the cover member is configured to produce an elastic force that presses the pair of side edge sections in the state where the cover member is attached to the support groove.

8. A roller unit comprising:

a second roller having a rotary shaft extending in parallel with a rotatably supported first roller; and the roller support mechanism according to claim 1.

9. A fixing device comprising:

the roller unit according to claim 8;

a rotatable third roller that is heated by a heating device;

the first roller that is rotatable in a state of being in pressure contact with the third roller;

a separation member made of resin and abutting against a surface of the third roller for separating from the third roller a sheet that has passed through a nip between the third roller and the first roller; and a cleaning member provided on a surface of the second roller of the roller unit and abutting against the first roller for removing any foreign matter adhered to a surface of the first roller.

* * * * *